US007229300B2

(12) United States Patent
Lai et al.

(10) Patent No.: US 7,229,300 B2
(45) Date of Patent: Jun. 12, 2007

(54) DRAWER-TYPE ALL-IN-ONE CARD CONNECTOR

(75) Inventors: Yaw-Huey Lai, Taipei County (TW); Nai-Hock Lwee, Singapore (SG)

(73) Assignee: Tai-Sol Electronics Co., Ltd., Taipei (TW)

( * ) Notice: Subject to any disclaimer, the term of this patent is extended or adjusted under 35 U.S.C. 154(b) by 0 days.

(21) Appl. No.: 11/376,244

(22) Filed: Mar. 16, 2006

(65) Prior Publication Data

US 2007/0105446 A1 May 10, 2007

(30) Foreign Application Priority Data

Nov. 7, 2005 (TW) ..... 94219240

(51) Int. Cl.
*H01R 13/62* (2006.01)

(52) U.S. Cl. ..... 439/159; 439/155

(58) Field of Classification Search ..... 439/157, 439/158, 159, 160, 155, 630
See application file for complete search history.

(56) References Cited

U.S. PATENT DOCUMENTS 6,319,028 B1 * 11/2001 Zhang et al. ..... 439/159
6,382,995 B1 * 5/2002 Bricaud et al. ..... 439/159
6,447,313 B1 * 9/2002 Zuin ..... 439/159
6,839,431 B2 * 1/2005 Ooya et al. ..... 379/433.09
6,942,507 B1 * 9/2005 Wu et al. ..... 439/159
6,951,471 B1 * 10/2005 Chen ..... 439/159
7,004,770 B2 * 2/2006 Wu ..... 439/159
2005/0186817 A1 * 8/2005 Yang et al. ..... 439/159
2005/0221649 A1 * 10/2005 Tanaka et al. ..... 439/159

* cited by examiner

*Primary Examiner*—Hien Vu
(74) *Attorney, Agent, or Firm*—Bacon & Thomas, PLLC

(57) ABSTRACT

A drawer-type all-in-one card connector includes a housing defining an insertion chamber and an opening formed at an end of the insertion chamber and a plurality of terminal slots formed at the other end of the insertion chamber; a plurality of card contact terminals mounted at the terminal slots; a sliding box slidably mounted in the insertion chamber of the housing and having a card receiving chamber for receiving corresponding memory cards of different specifications; a cover covered on the housing; a first ejection spring having two ends contacting against an inner sidewall of the housing and the sliding box respectively; and a limiter provided between the housing and the sliding box.

8 Claims, 7 Drawing Sheets

DRAWER-TYPE ALL-IN-ONE CARD CONNECTOR

BACKGROUND OF THE INVENTION

1. Field of the Invention

The present invention relates to memory card connectors and more particularly, to a drawer-type all-in-one card connector.

2. Description of the Related Art

A regular card connector is made based on an all-in-one structure capable of receiving different memory cards, i.e., its housing has therein multiple insertion chambers and multiple sets of terminals for receiving different memory cards, such as Memory Stick (MS) card, Smart Media (SM) card, Multi-Media Card (MMC), and Secure Digital (SD) card.

A conventional all-in-one card connector has multiple insertion chambers separately defined without interference, i.e. two or more memory cards can be inserted into the housing at the same time. If the user inserts two or more memory cards into the housing at the same time accidentally, a reading or writing error may occur to result in malfunction of the card connector. Further, when the user inserts a memory card into the housing obliquely or improperly, the inserted memory card may damage the internal structure of the card connector.

Therefore, it is desirable to provide an all-in-one card connector that eliminates the aforesaid problems.

SUMMARY OF THE INVENTION

The primary objective of the present invention to provide a drawer-type all-in-one card connector which employs a sliding box thereof to carry one memory card only once and to keep an inserted memory card electrically connected to internal terminals thereof, thus avoiding the problems incurred while multiple memory cards are inserted.

The secondary objective of the present invention to provide a drawer-type all-in-one card connector which keeps the inserted memory card in correct electric connection with the internal terminals thereof and avoids damage incurred by oblique or improper insertion of the inserted memory card to the internal structure of the card connector.

The third objective of the present invention to provide a drawer-type all-in-one card connector which is equipped with ejection springs and a limiter for correct and automatic insertion or ejection of one memory card.

The fourth objective of the present invention to provide a drawer-type all-in-one card connector which has an arched finger notch at one end of the sliding box thereof so that the user can conveniently insert/remove a memory card into/from the sliding box.

To achieve the foregoing objects of the present invention, the drawer-type all-in-one card connector includes a housing defining an insertion chamber and an opening formed at an end of the insertion chamber and a plurality of terminal slots formed at the other end of the insertion chamber; a plurality of card contact terminals mounted at the terminal slots; a sliding box slidably mounted in the insertion chamber of the housing and having a card receiving chamber for receiving corresponding memory cards of different specifications; a cover covered on the housing; a first ejection spring having two ends contacting against an inner sidewall of the housing and the sliding box respectively; and a limiter provided between the housing and the sliding box.

Further, the sliding box has two positioning grooves and a movable block member mounted in the card receiving chamber for positioning a memory card in the card receiving chamber and having two positioning pins mounted to the positioning grooves for guiding movement of the movable block along the positioning grooves, and spring means for positioning the movable block member in the card receiving chamber.

Further, the movable block member has at least one positioning plate mounted at an end thereof abutting the card contact terminals for positioning a memory card in the card receiving chamber.

Further, the housing has a guide rod forwardly extending from the upright sidewall toward the insertion chamber, and a first ejection spring sleeved onto the guide rod of the housing.

Preferably, the first ejection spring is a compression spring.

The drawer-type all-in-one card connector further includes a second ejection spring having two end tips mounted to the housing and the sliding box respectively.

Further, the sliding box is drawer-typed, having an arched finger notch formed at one end thereof and a positioning hole formed at the other end thereof.

Further, the housing includes a positioning hole formed on a top side thereof. The second ejection spring has two end tips mounted to the positioning holes of the housing and the sliding box respectively.

Preferably, the second ejection spring is a torsion spring.

Further, the cover is U-shaped, having a plurality of elastic portions for positioning a memory card in the sliding box.

Further, the limiter includes a locating groove provided at one side of the sliding box, a locating rod having two ends mounted to a positioning hole of the housing and a second end engaging the locating groove, and a positioning plate for positioning the locating rod and keeping the second end of the locating rod in close contact with said locating groove.

DETAILED DESCRIPTION OF THE INVENTION

Figure 1:
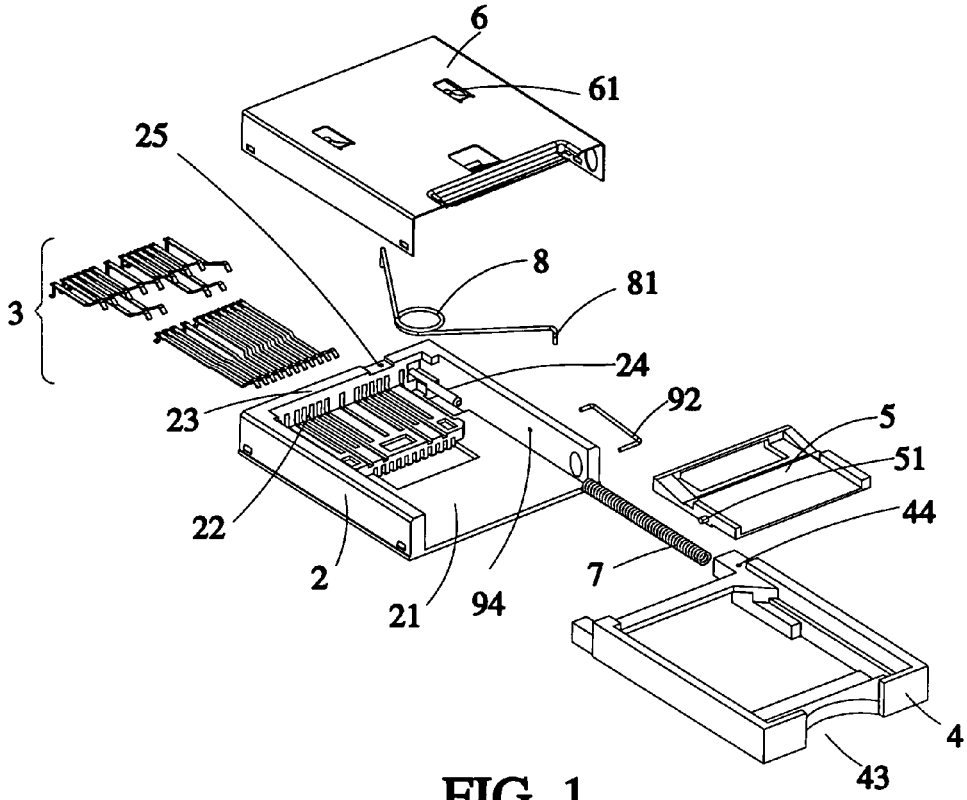
FIG. 1 is an exploded view of a drawer-type all-in-one card connector according to a first preferred embodiment of the present invention.
Figure 2:
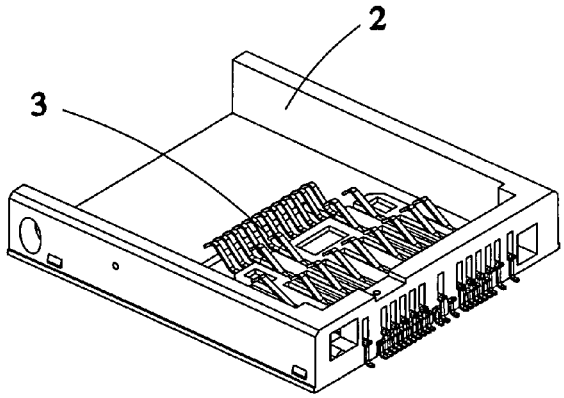
FIG. 2 is a perspective view of a part of the first preferred embodiment of the present invention, showing the card contact terminals installed in the housing.
Figure 3:
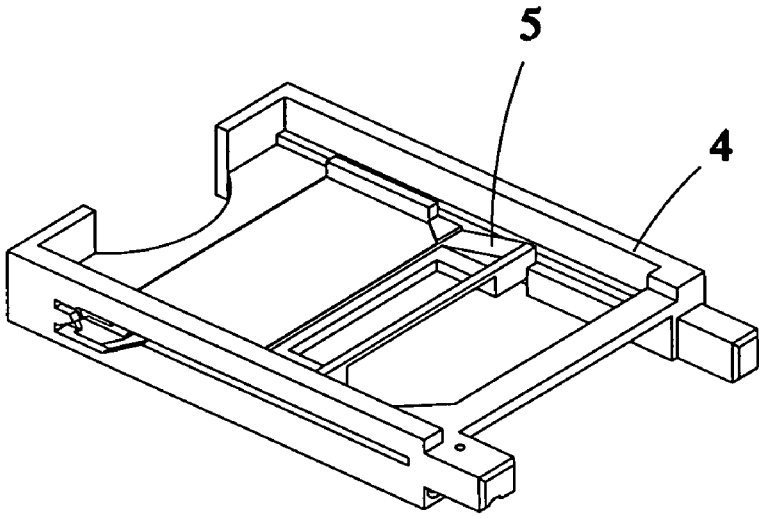
FIG. 3 is another perspective view of the first preferred embodiment of a part of the present invention, showing the sliding box and the movable block member.
Figure 4:
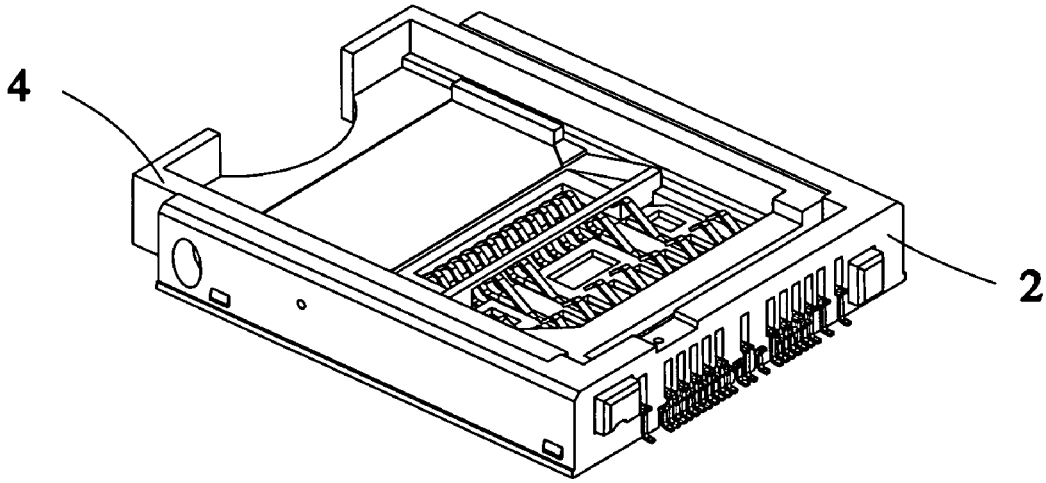
FIG. 4 is another perspective view of a part of the first preferred embodiment of the present invention, showing that the card contact terminals, the sliding box, and the housing are assembled.
Figure 5:
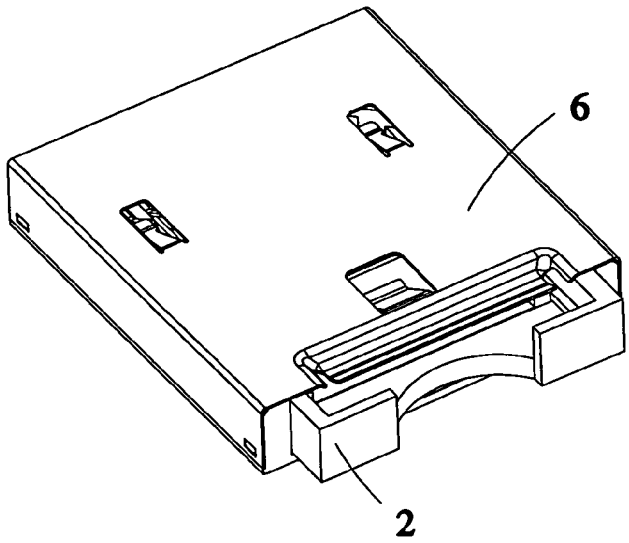
FIG. 5 is another perspective view of the drawer-type all-in-one card connector according to the first preferred embodiment of the present invention.
Figure 6:
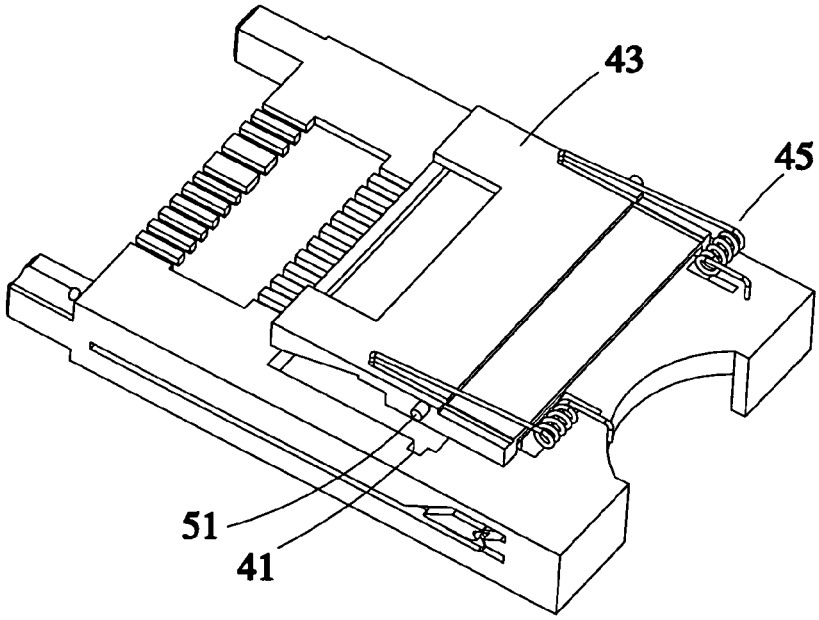
FIG. 6 is a schematic view of a part of the first preferred embodiment of the present invention, showing the movable block member positioned in the sliding box.

Referring to FIGS. 1–6, a drawer-type all-in-one card connector in accordance with the present invention is shown comprised of a housing 2, a plurality of card contact terminals 3, a sliding box 4, a movable block member 5, a cover 6, a first ejection spring 7, a second ejection spring 8, and a limiter 9.

The housing 2 is rectangular, having an upright rear wall 23, an insertion chamber 21, an opening formed at an open end of the insertion chamber, a plurality of sets of terminal slots 22 formed at the other end of the insertion chamber 21 and located on the upright rear wall 23 for mounting the card contact terminals 3, a guide rod 24 forwardly extending from an inner side of the upright rear wall 23 toward the insertion chamber 21, and two positioning holes 25 and 94 formed on a top side of upright rear wall 23. The limiter 11 is located between the housing 2 and the sliding box 4.

The sliding box 4 is drawer-typed and is slidably mounted in the insertion chamber 21 of the housing 2, having two positioning grooves 41 for receiving the movable block member 5, an arched finger notch 43 formed at one end thereof, and a positioning hole 44 formed at the other end thereof.

The movable block member 5 includes two positioning pins 51 disposed therein and mounted to the positioning grooves 41 respectively to guide vertical movement of the movable block member 5 relative to the sliding box 4 along the positioning groove 41. Further, spring members 45 are provided to hold the movable block member 5 in the sliding box 4, allowing the movable block member 5 to be moved by an internal force along the positioning groove 41. The movable block member 5 and the sliding box 4 define a card receiving chamber capable of receiving any of a variety of memory cards including SD card, MMC card, RS-MMC (Reduced Size Multimedia Card) card, and MINI SD card.

The cover 6 has a substantially U-shaped cross-section, being covered on the housing 2. Further, the cover 6 has a plurality of elastic portions 61 for holding down any inserted memory card in the sliding box 4.

The first ejection spring 7 is a compression spring sleeved onto the guide rod 24 of the housing 2, having two ends contacting against the upright rear wall 23 and the sliding box 4 respectively. The second ejection spring 8 is a torsion spring, having two end tips 81 mounted to the positioning holes 25 and 44 of the housing 2 and the sliding box 4 respectively.

Figure 7:
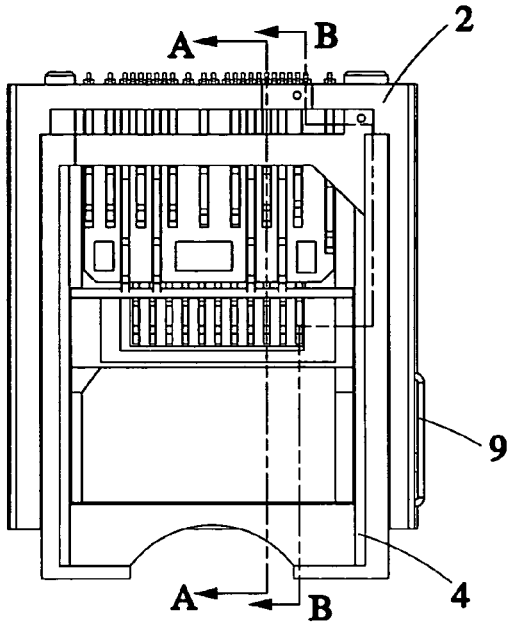
FIG. 7 is a schematic top view of a part of the first preferred embodiment of the present invention, showing the sliding box inserted into the housing.
Figure 8:
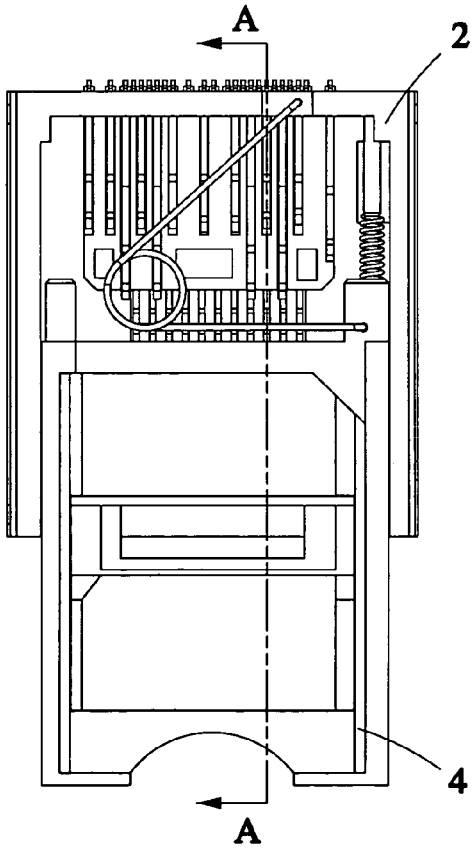
FIG. 8 is a schematic view of the first preferred embodiment of the present invention, showing that the first ejection spring forces the sliding box partially to eject out of the insertion chamber of the housing.
Figure 9:
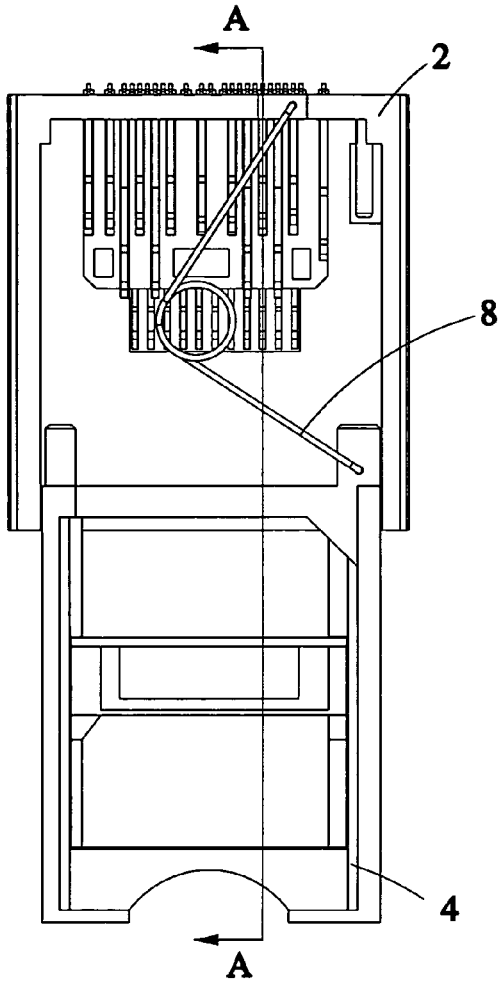
FIG. 9 is a schematic view of the first preferred embodiment of the present invention, showing the second ejection spring forces the sliding box to eject out of the insertion chamber of the housing.

FIGS. 7–9 show the ejection of the sliding box 4 out of the insertion chamber 21 of the housing 2. FIG. 7 shows the sliding box 4 inserted into the insertion chamber 21 and stopped in position by the limiter 9. FIG. 8 shows the sliding box 4 forced outwards from the insertion chamber 21 of the housing 2 by the first ejection spring 7. FIG. 9 shows the sliding box 4 ejected out of the insertion chamber 21 of the housing 2 by the second ejection spring 8.

Figure 10:
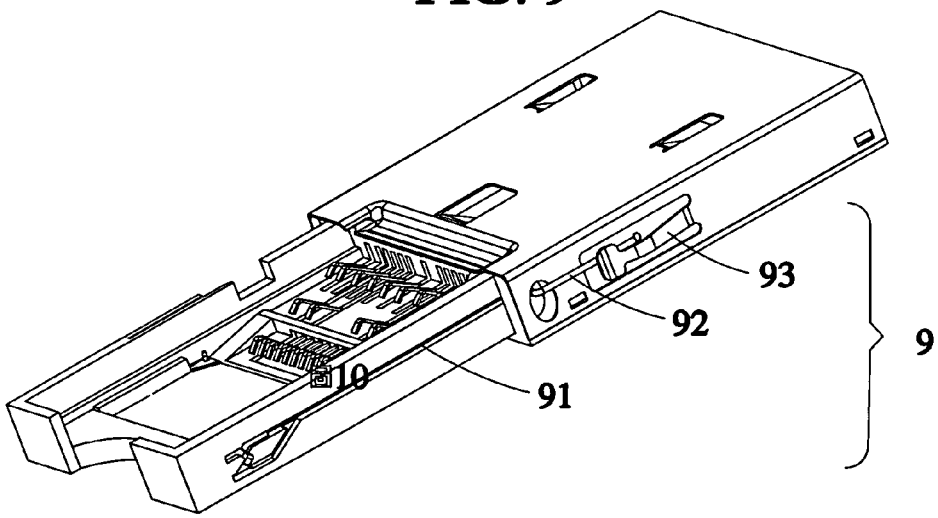
FIG. 10 is a schematic view of a part of the first preferred embodiment of the present invention, showing the structure of the limiter.

Referring to FIG. 10 as well as FIG. 1 again, the limiter 9 includes a locating groove 91, a locating rod 92, and a positioning plate 93. The locating groove 91 is provided at one side of the sliding box 4. The locating rod 92 has one end mounted to the positioning hole 94 of the housing 2 and the other end thereof engaging the locating groove 91. When the sliding box 4 receives an external force, the locating rod 92 limits the movement of the sliding box 4 of the housing 2 along a predetermined path.

In the aforesaid embodiment, the movable block member 5 is an independent member movably mounted to the sliding box 4. Alternatively, the movable block member 5 can be combined with the sliding box 4 in one piece.

Figure 11:
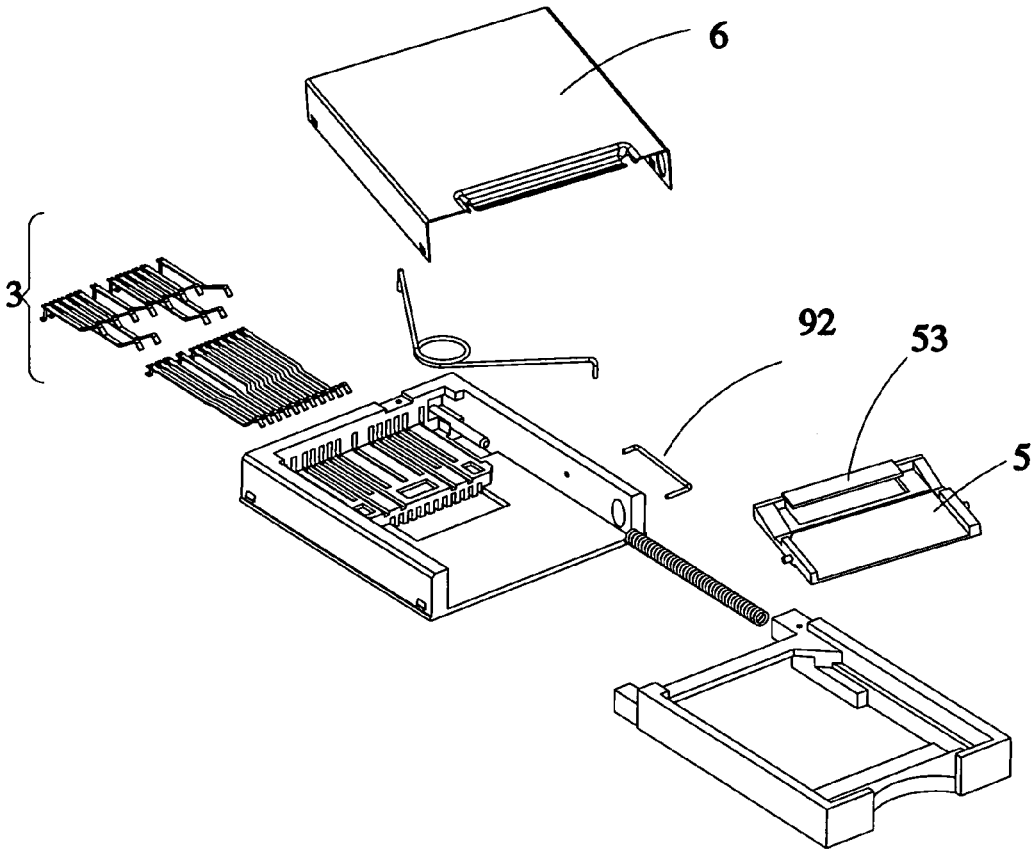
FIG. 11 is an exploded view of the drawer-type all-in-one card connector according to a second preferred embodiment of the present invention.
Figure 12:
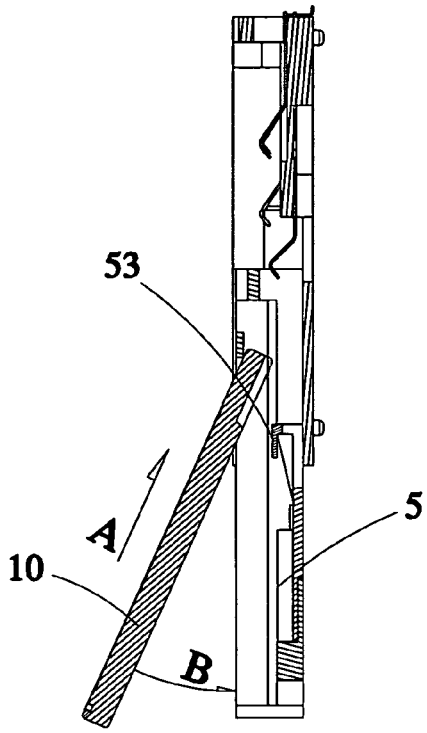
FIG. 12 is a schematic drawing showing a memory card obliquely inserted into the sliding box of the drawer-type all-in-one card connector according to the second preferred embodiment of the present invention.
Figure 13:
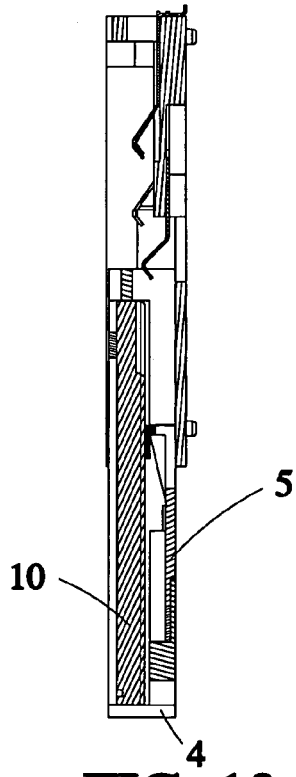
FIG. 13 corresponds to FIG. 12, showing the memory card inserted into and positioned in the sliding box.

FIG. 11 shows the drawer-type all-in-one card connector according to a second preferred embodiment the present invention. In this embodiment, the movable block 5 has a positioning plate 53 mounted at one side abutting the contact terminals 3 for positioning the inserted memory card. As shown in FIGS. 12 and 13, a memory card 10 is obliquely inserted into the card receiving chamber and then held down in position by the positioning plate 53 of the movable block member 5. In this embodiment, the aforesaid elastic portions 61 are excluded.

As indicated above, the drawer-type all-in-one card connector of the present invention employs the sliding box to hold down the inserted memory card, keeping the inserted memory card electrically connected to the card contact terminals. The present invention also allows insertion of any of a variety of memory cards.

By means of the sliding box, the inserted memory card is maintained positively electrically connected to the card contact terminals, avoiding damage to the internal structure of the connector due to improper insertion angle of the memory card.

By means of the ejection springs and the limiter, the memory card can conveniently and accurately be inserted into position or smoothly ejected out of the housing.

Further, with the arched finger notch at one end of the sliding box, the user can conveniently insert a memory card into the inside of the sliding box or remove the inserted memory card from the sliding box.

Although a particular embodiment of the invention has been described in detail for purposes of illustration, various modifications and enhancements may be made without departing from the spirit and scope of the invention. Accordingly, the invention is not to be limited except as by the appended claims

What is claimed is:

1. A card connector comprising:

a housing having an insertion chamber, an opening formed at an open end of said insertion chamber, and a plurality of terminal slots formed at the other end of said insertion chamber;

a plurality of card contact terminals mounted to said terminal slots;

a sliding box slidably mounted in said insertion chamber of said housing and having a card receiving chamber for receiving a corresponding memory card;

a cover covered on said housing;

a first ejection spring having two ends contacting against an inner sidewall of said housing and said sliding box respectively; and a second ejection spring, said second ejection spring having two end tips mounted to said housing and said sliding box respectively a limiter having a locating groove and a locating rod mounted between said housing and said sliding box, wherein said sliding box is a drawer having an arched finger notch formed at one end thereof and a positioning hole formed at the other end thereof, wherein said housing includes a positioning hole formed at a top side of said upright sidewall thereof, and wherein said second ejection spring having two end tips mounted to said positioning holes of said housing and said sliding box respectively.

2. The card connector as claimed in claim 1, further comprising a movable block member and two positioning grooves formed in the housing, said movable block member having two positioning pins, said movable block member being positioned on said sliding box by said positioning pins and said positioning grooves for vertical movement forced by at least one spring means mounted on said sliding box, said sliding box and said movable block member together defining a card receiving chamber for receiving a corresponding card.

3. The card connector as claimed in claim 2, wherein said movable block member has at least one positioning plate mounted at an end thereof abutting said contact terminals for positioning a memory card in said card receiving chamber.

4. The card connector as claimed in claim 1, wherein said housing further comprises an upright sidewall and a guide rod extending from said upright sidewall toward said insertion chamber; said first ejection spring is positioned onto said guide rod.

5. The card connector as claimed in claim 4, wherein said first ejection spring is a compression spring.

6. The card connector as claimed in claim 1, wherein said second ejection spring is a torsion spring.

7. The card connector as claimed in claim 1, wherein said cover has a substantially U-shaped cross-section and a plurality of elastic portions for holding a memory card in said sliding box.

8. The card connector as claimed in claim 1, wherein said limiter further comprises a positioning plate, said locating rod having two ends mounted to said positioning hole of said housing and engaging said locating groove respectively, said positioning plate being provided for positioning said locating rod and keeping one end of said locating rod fastened to the positioning hole of said housing for close contact with said locating groove.

* * * * *